US006059239A

United States Patent [19]

Wheeler

[11] Patent Number: 6,059,239

[45] Date of Patent: May 9, 2000

[54] POSTURE CHAIR FOR EXCEPTIONALLY HEAVY OCCUPANTS

[75] Inventor: Kenneth L. Wheeler, Goshen, Ind.

[73] Assignee: Sican Corp, Elkhart, Ind.

[21] Appl. No.: 09/122,873

[22] Filed: Jul. 27, 1998

[51] Int. Cl.[7] ..... A47B 91/00

[52] U.S. Cl. ..... 248/188.7; 248/519; 248/523

[58] Field of Search ..... 248/188.7, 188.8, 248/188, 188.1, 163.1, 164, 431, 523, 519, 425, 161, 163.2; 428/18; 297/285, 445, 344.18, 353, 286

[56] References Cited

U.S. PATENT DOCUMENTS

| | | | |
|---|---|---|---|
| 2,295,281 | 9/1942 | Grunwald | 248/188.7 |
| 3,278,229 | 10/1966 | Bates | 297/344.18 |
| 3,499,625 | 3/1970 | Froedge | 248/188.7 |
| 3,854,772 | 12/1974 | Abrahamson et al. | 297/353 |
| 4,131,315 | 12/1978 | Vogtherr | 297/286 |
| 4,318,570 | 3/1982 | Adam et al. | 297/445 |
| 4,408,800 | 10/1983 | Knapp | 297/285 |
| 4,703,974 | 11/1987 | Brauning | 297/285 |
| 4,830,324 | 5/1989 | Neville | 248/425 |
| 4,898,353 | 2/1990 | Jih et al. | 248/188.7 |
| 5,527,010 | 6/1996 | Kao | 248/519 |
| 5,542,746 | 8/1996 | Bujaryn | 297/423.12 |
| 5,639,056 | 6/1997 | Mecalf | 248/523 |
| 5,713,554 | 2/1998 | Lai | 248/522 |
| 5,752,684 | 5/1998 | Larkin | 248/188.7 |
| 5,869,151 | 2/1999 | Chong | 428/18 |

*Primary Examiner*—Ramon O. Ramirez
*Assistant Examiner*—Tan Le
*Attorney, Agent, or Firm*—The Firm of Gordon W. Hueschen

[57] ABSTRACT

A posture chair for heavy duty use in business offices and particularly designed to support exceptionally heavy occupants. In order to support heavy occupants a large number of legs are utilized in the chair base to support the chair, preferably eight. The invention further resides in the use of a support plate, such as a heavy gauge metal disc or washer affixed to the legs of the chair, and contoured to conform to the slope of the legs. The disc or washer, preferably formed of steel, is placed in the preferred embodiment under the legs and welded thereto by weld beads placed in the corner at which each side of each leg engages the disc or washer and also between the disc and hub. This results in an exceptionally strong structure sufficient to support very heavy occupants. These elements of the chair base may also be integral and of cast metal, e.g., aluminum.

5 Claims, 4 Drawing Sheets

POSTURE CHAIR FOR EXCEPTIONALLY HEAVY OCCUPANTS

TECHNICAL FIELD

1. Field of the Invention

The present invention relates to posture chairs designed for heavy duty service, particularly in business offices, and more particularly refers to such chairs designed to support exceptionally heavy occupants.

2. Description of the Prior Art

Various posture chairs are known in the art. For example, U.S. Pat. No. 4,170,382 discloses such a chair having means for adjusting the spring-loaded tension supporting the movable back support of the chair. Other references have disclosed other features of posture chairs. Attempts have been made to provide posture chairs having the capability of supporting heavy occupants by providing more legs than commonly used. However, these chairs still have the deficiency that, when utilized to support exceptionally heavy occupants, the legs break apart from the central column.

OBJECTS OF THE INVENTION AND ADVANTAGES

It is an object of the present invention to provide a posture chair suitable for constant heavy duty use in business offices.

It is a primary object of the invention to provide a posture chair of the type described having a chair base structure which is sufficiently strong to support exceptionally heavy occupants for day in and day out use over long periods of time.

The foregoing and other objects, advantages, and characterizing features of the invention will become apparent from the following description of certain illustrative embodiments thereof, considered together with the accompanying drawings, wherein like reference numerals signify like elements throughout the various figures.

According to the invention, a chair is provided having a vertical or spindle member supported by a unique chair base. The upper end of the vertical member supports a seat frame which in turn supports a seat, a back rest, and arm rests. The chair base comprises a hub in which the vertical member is mounted. Affixed to the hub are a plurality of legs, preferably five, six, or eight. Below the legs is a support plate in the form of a disc or washer having a central aperture to receive a portion of the hub. The disc or washer is preferably dished to conform to the curvature or angle of the legs. The legs are preferably affixed to the disc or washer by placing a weld bead in the corners where the sides of the legs meet the surface of the disc or washer. The disc may be and preferably is welded to the hub. This creates a very strong base structure which enables the chair to support exceptionally heavy occupants during heavy commercial office usage.

SUMMARY OF THE INVENTION

What I believe to be my invention, then, singly or in combination, comprises the following, inter alia:

A posture chair comprising:

a chair base, a vertical spindle member having one end mounted in said chair base, a seat support member mounted at the other end of said vertical spindle member, a back support member mounted on said seat support member, and a back mounted on said back support member, said chair base comprising a hub having the lower end of said vertical spindle member mounted therein, a plurality of legs, e.g., five, six, or eight legs, each attached at one end to said hub, and a support plate adjacent said hub having each of said legs affixed thereto; such a posture chair wherein said support plate comprises a disc; such a posture chair wherein said disc has a central aperture permitting a portion of said hub to extend therethrough; such a posture chair wherein said legs are welded to said disc; such a posture chair wherein said disc is also welded to said hub; such a posture chair wherein said disc is positioned below said legs, and said legs are welded to the upper surface of said disc; such a posture chair wherein said disc is also welded to said hub; such a posture chair wherein the lower surfaces of said legs are angled downwardly and radially outwardly, and said disc is dished accordingly to provide contact engagement between the lower surfaces of said legs and the upper surface of said disc; such a posture chair wherein the lower surfaces of said legs are affixed to the upper surface of said disc by means of a plurality of weld beads placed one at each corner of each leg where the corner engages the upper surface of said disc, said weld beads extending along substantially the entire radius of said disc; such a posture chair wherein said weld beads extend to within about ¼ inch from the outer edge of said disc; such a posture chair wherein said disc has a diameter of about five inches; such a posture chair wherein a caster is provided at the end of each leg; such a posture chair wherein a foot rest ring is affixed to said legs; such a posture chair wherein said disc is formed of steel; such a posture chair wherein said chair base is provided with six or eight legs; and such a posture chair wherein arm rests are mounted on said chair.

Also, a posture chair comprising:

a chair base, a vertical spindle member having one end mounted in said chair base, a seat support member mounted at the other end of said vertical spindle member, said chair base comprising a hub having the lower end of said vertical spindle member mounted therein, a plurality of legs, e.g., five, six, or eight legs, each attached at one end to said hub, and a support plate adjacent said hub having each of said legs affixed thereto; such a posture chair wherein said support plate comprises a disc having a central aperture permitting a portion of said hub to extend therethrough, said disc being positioned below said legs, and said legs being welded to the upper surface of said disc; such a posture chair wherein the lower surfaces of said legs are angled downwardly and radially outwardly, and said disc is dished accordingly to provide contact engagement between the lower surfaces of said legs and the upper surface of said disc; such a posture chair wherein the lower surfaces of said legs are affixed to the upper surface of said disc by means of a plurality of weld beads placed one at each corner of each leg where the corner engages the upper surface of said disc, said weld beads extending along substantially the entire radius of said disc, and wherein said disc is also welded to said hub; such a posture chair wherein said chair base is provided with six or eight legs; and finally such a posture chair wherein all of the three elements of the chair base are integral and of cast metal.

BRIEF DESCRIPTION OF THE DRAWINGS

Reference is now made to the drawings for a better understanding of the invention wherein.

DETAILED DESCRIPTION OF THE INVENTION

Figure 1:
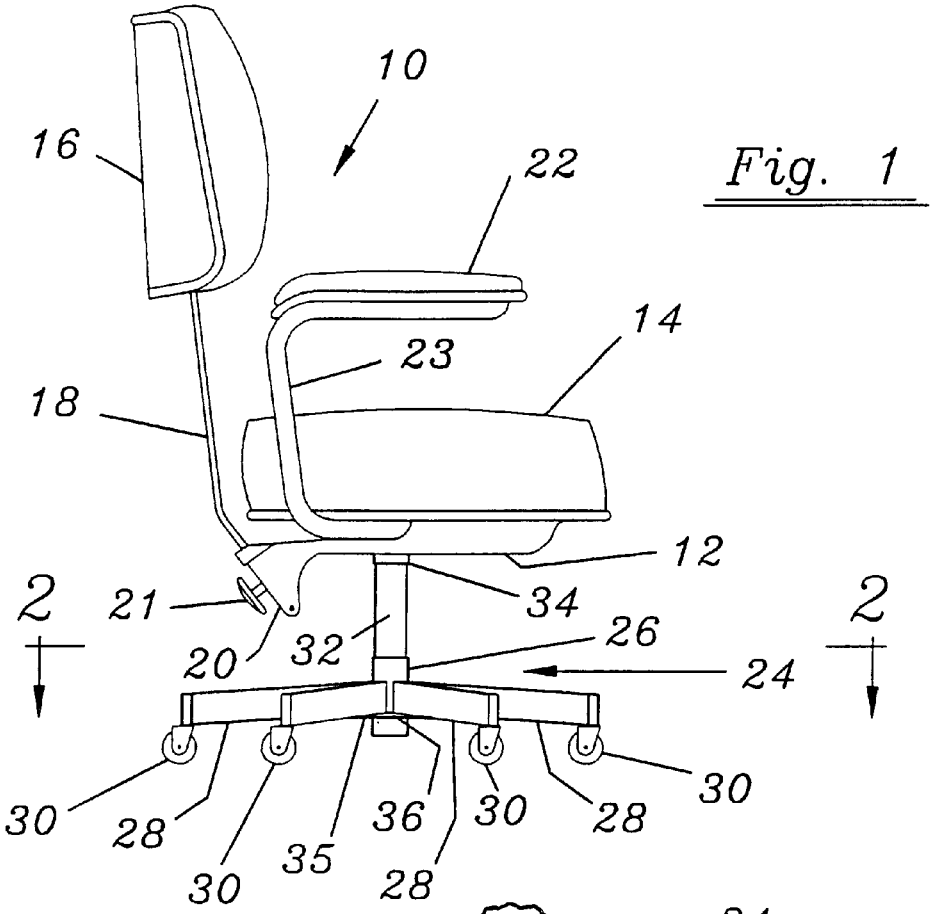
FIG. 1 is a side elevational view of a posture chair according to the invention.
Figure 1A:
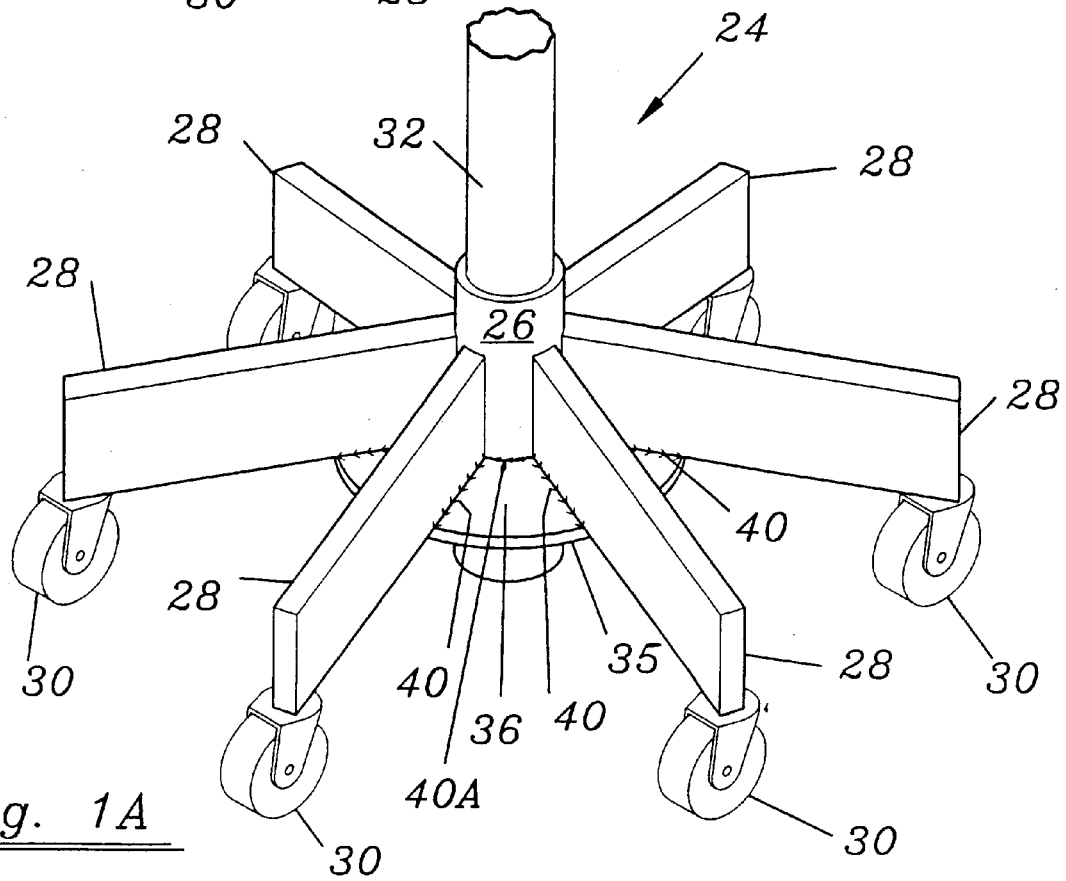
FIG. 1A is a perspective view of the chair base shown in FIG. 1.

Referring to FIGS. 1 and 1A, the posture chair 10 according to the invention is shown comprising a seat base 12 supporting a seat 14 and a back rest 16. The back rest 16 is supported by a back rest support member 18, an end of which is adjustably supported in a receptacle 20 provided in seat base 12, and which is retained therein by means of a set screw 21. Arm rests 22 are affixed to extensions 23 in turn affixed to the seat base 12 on each side of the chair.

Shown in greater detail in FIG. 1A, the unique chair base 24 comprises a hub 26 to which are affixed the ends of a plurality of legs 28. Each leg has a caster 30 mounted at the end thereof. A vertical spindle member 32 is rotatably mounted at its lower end in the hub 26, and at its upper end is connected to the seat base 12 by collar 34, i.e., in such manner as to permit the seat 14 and seat base 12 to rotate via spindle member 32 within hub 26.

Figure 2:
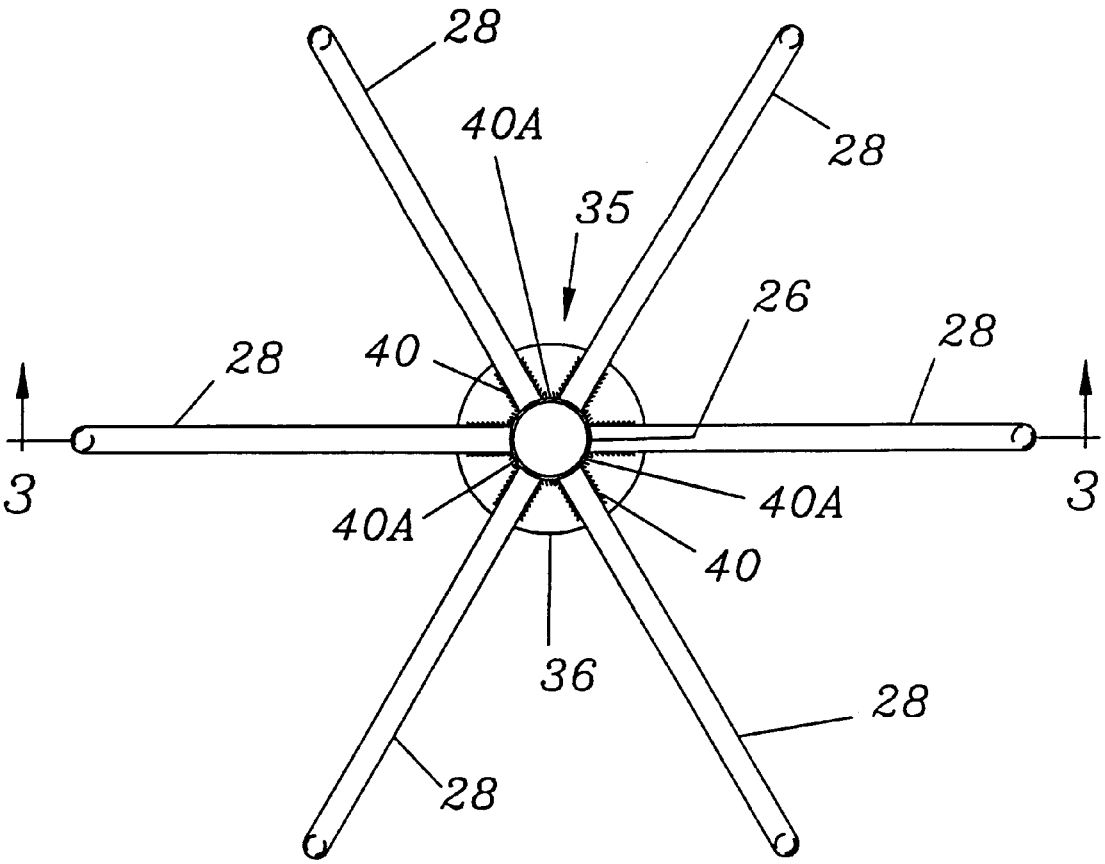
FIG. 2 is a view taken at the line 2—2 of FIG. 1.
Figure 3:
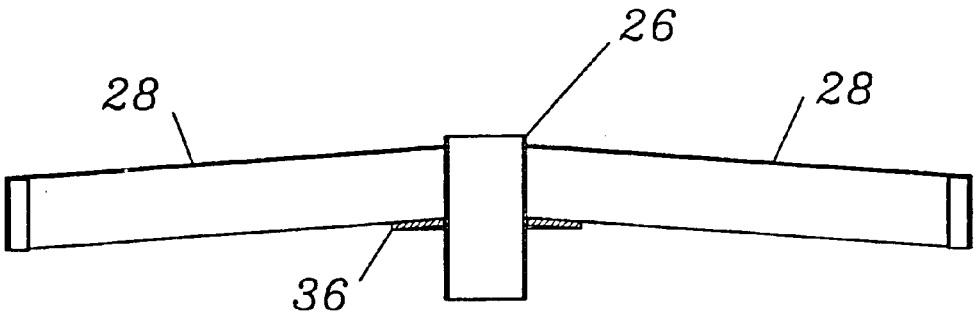
FIG. 3 is a cross-sectional view taken at the line 3—3 of FIG. 2.

Mounted below the legs 28 is a support plate 35 in the form of a disc or washer 36 formed of a steel plate. In the embodiments in which the hub 26 descends below the disc or washer 36, an aperture 38 is provided to permit the hub 26 to pass through the disc or washer 36, as shown in greater detail in FIGS. 1, 6, and 7. The disc or washer 36 is welded to the legs 28 by means of weld beads 40 applied between the washer 36 and each corner of each leg 28, as shown in FIGS. 1A and 2. The presence of the washer 36 welded to the legs 28 greatly increases the strength of the chair base and permits occupants weighing as much 500 to 650 pounds to be safely seated in the chair without danger of having the legs of the chair broken or pulled apart from the hub 26. As shown in FIGS. 1A and 2, disc 36 may be and usually is also connected to hub 26 by weld beads 40A.

Figure 4:
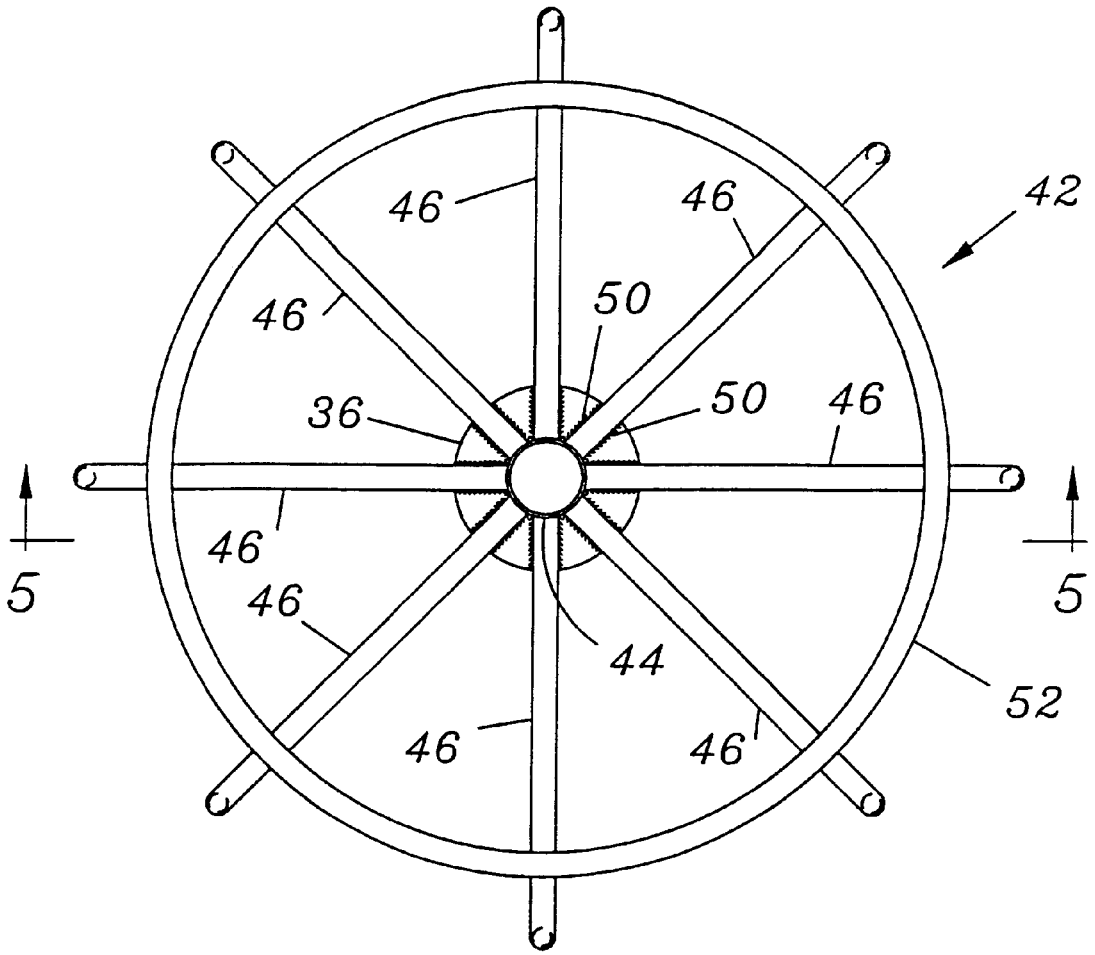
FIG. 4 is a view similar to that of FIG. 2, but illustrating a somewhat modified embodiment.
Figure 5:
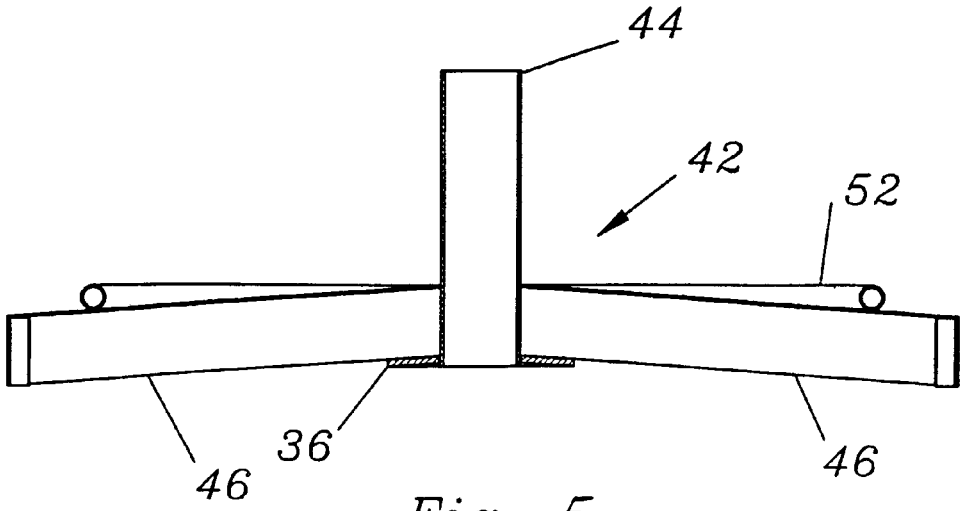
FIG. 5 is a cross-sectional view taken at the line 5—5 of FIG. 4.

Referring to FIGS. 4 and 5, a chair base 42 is illustrated having a hub 44, and eight legs 46 provided for additional safety. The presence of eight legs renders it feasible to seat safely occupants weighing as much as 650 pounds. A disc or washer 36 is welded to the legs 46 by means of weld beads 50 placed between two corners of each leg 46 and the upper surface of the disc or washer 36. Additionally, in the embodiment shown in FIGS. 4 and 5, a foot rest ring 52 is affixed to the legs 46.

Figure 6:
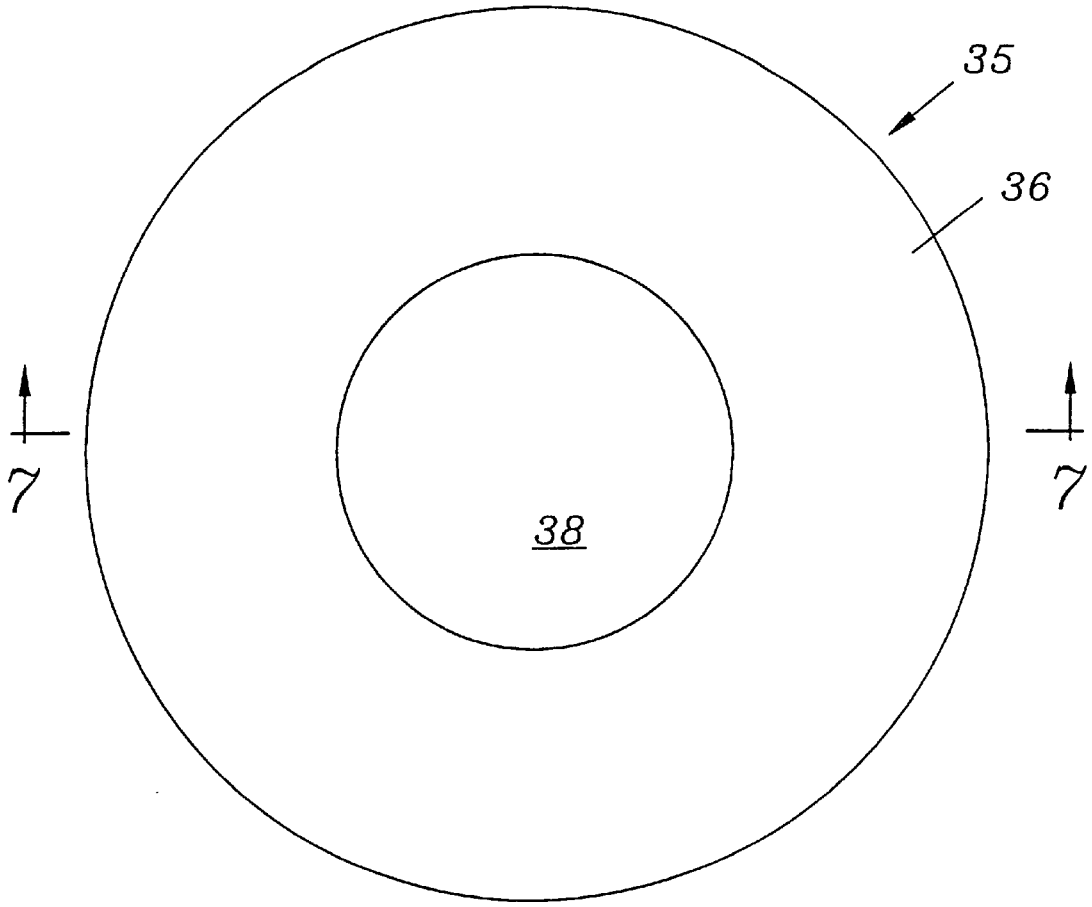
FIG. 6 is a plan view of a disc or washer according to the invention.
Figure 7:
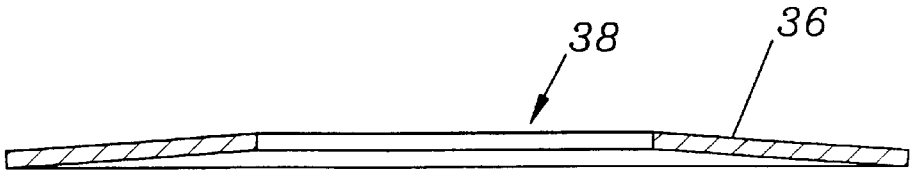
FIG. 7 is a cross-sectional view taken at the line 7—7 of FIG. 6.

Referring to FIGS. 6 and 7, the disc or washer 36 is shown in greater detail. It is provided with a central aperture 38 in order to permit the hub 26 or 44 to extend therethrough. The disc or washer 36 in the preferred embodiment is formed of a steel plate of rather heavy gauge, although other suitable metal such as aluminum may be used. The preferred diameter of the disc or washer 36 is preferably about five inches, although other diameters may be utilized, depending on the contemplated size of the occupant. The weld beads 40 or 50 are placed on each side of each leg in the corners where the sides of each leg engage the disc or washer 36. The weld beads 40 or 50 are optimally applied to extend from the hub 26 or 44 to within about ¼" from the edge of the disc or washer 36.

As is shown in FIG. 7, the disc or washer 36 is dished or concave. Such a washer is commonly referred to as a Belleville washer. The washer 36 is dished in order to conform to the angle of the lower surfaces of the legs 28 or 46 in the embodiments wherein the washer 36 is placed below the legs 28 and 46. This is the preferred embodiment. In other embodiments wherein the washer 36 is placed above the legs 28 or 46, the washer 36 is dished at an angle to conform to the angle of the upper surfaces of the legs 28 or 46.

The disc or washer 36 may be affixed to the legs 28 or 46 by any suitable means such as by means of screws, bolts, or other commonly used means. However, the preferred means of affixing the disc or washer 36 to the legs 28 or 46 is by means of the weld beads 40 and 50 described above.

The posture chair of the present invention has been described above in detail with regard to the chair base 24 comprising the hubs 26 and 44, the legs 28 and 46 and the disc or washer 36, since the inventive concept of the chair resides in that structure. However, it is to be understood that the present chair may also include various features generally provided in posture chairs, such as pneumatic means for lifting the seat and spring means for spring biasing the back of the chair.

IN GENERAL

As just stated, the relationship between the chair seat 14 and seat base 12 and the spindle member 32 and the hub 26 is subject to numerous variations and may take many different forms, all of which are unimportant from the standpoint of the present invention. As disclosed, the spindle member 32 is rotatably mounted at its lower end in the hub 26 and at its upper end is preferably fixedly connected to the seat base 12. In addition, the disc 36 may be and usually is also connected to hub 26 by weld beads 40A, as shown in FIGS. 1A and 2, which may be located partially or completely around the juncture of disc 36 and hub 26, as at points between those points at which the ends of the legs 28 are affixed to the hub 26. Ordinarily the spindle member 32 is fixedly connected to the seat base 12 as by collar 34 as shown, together with any ordinary connecting means.

Means may also be included for raising and lowering the chair seat and seat base with respect to the chair base 24 and the hub 26 thereof, but these variations are also unimportant from the standpoint of the present invention and are not depicted in detail inasmuch as they can all be considered a part of or mere variations of or additions to the spindle member 32 for purposes of the present invention or merely as conventional ancillary seat-height adjusting elements.

Thus, as is conventional, when the spindle is rotatably mounted in the hub, the welded hub usually and preferably comprises a female taper therein, and an internal hub may also be provided with a male taper so that the two hubs are locked together. The external hub is fixed to the chair base and the internal hub may be affixed via the spindle to the seat base. The spindle may also have an adjusting bell hand wheel so that the spindle is free to rotate inside the inner hub whereas the hand bell provides vertical seat adjustment since the spindle and hand bell are threaded for such purpose. Thus a turning of the hand bell relative to the spindle can change the height of the chair.

A gas cylinder, which may contain a piston, piston rod, and other associated elements, can also be a means of raising and lowering the chair seat and, in such case, the gas cylinder takes the place of and effectively is the spindle.

Another type of seat-height adjusting means is a mechanical device which operates to provide free wheeling when the user is seated but which, when the user stands up, can be adjusted as to height due to suitable threadings on the spindle and chair seat base.

In addition, the entire chair base with the exception of casters can be integral and of cast metal, e.g., aluminum, thereby providing the chair legs, the plate or disc, and the hub as a single unitary device in exactly the same form as depicted by the accompanying drawings.

The invention has been described in an illustrative manner, and it is to be understood that the terminology used is intended to be in the nature of description rather than of limitation.

It is thereby seen from the foregoing that the objects of the present invention have been accomplished and that a novel, efficient, and economic apparatus have been provided, all in accord with the Objects of the Invention and the Summary of Invention as set forth hereinbefore.

It is to be understood that the present invention is not to be limited to the exact details of operation, or to the exact embodiments shown and described, as various modifications and equivalents will be apparent to one skilled in the art, wherefore the present invention is to be limited only by the full scope which can be legally accorded to the appended claims.

I claim:

1. A posture chair comprising:

a chair base, a vertical spindle member having upper and lower ends and having its lower end mounted in said chair base, a seat support member mounted at the upper end of said vertical spindle member, a back support member mounted on said seat support member, and a back mounted on said back support member, said chair base comprising a hub having the lower end of said vertical spindle member mounted therein, a plurality of legs each attached at one end to said hub, and a support plate adjacent said hub having each of said legs affixed thereto, wherein said support plate comprises a disc, wherein said disc has a central aperture permitting a portion of said hub to extend therethrough, wherein said legs are welded to said disc, wherein said disc is positioned below said legs, and said legs are welded to the upper surface of said disc, wherein said disc is also welded to said hub, wherein the legs have upper and lower surfaces and wherein the lower surfaces of said legs are angled downwardly and radially outwardly, and said disc has upper and lower surfaces and is dished accordingly to provide contact engagement between the lower surfaces of said legs and the upper surface of said disc, wherein the lower surfaces of said legs are affixed to the upper surface of said disc by means of a plurality of weld beads placed one at each corner of each leg where the corner engages the upper surface of said disc, said weld beads extending along substantially the entire radius of said disc and to within about ¼ inch from the outer edge of said disc, wherein said disc has a diameter of about five inches, wherein said disc is formed of steel, and wherein said chair base is provided with six or eight legs.

2. A posture chair according to claim 1, wherein a caster is provided at the end of each leg.

3. A posture chair according to claim 1, wherein a foot rest ring is affixed to said legs.

4. A posture chair according to claim 1, wherein arm rests are mounted on said chair.

5. A posture chair according to claim 1, wherein said chair base is provided with eight legs.

* * * * *